US009065200B2

(12) United States Patent
Kim et al.

(10) Patent No.: US 9,065,200 B2
(45) Date of Patent: Jun. 23, 2015

(54) CONNECTOR, AND ASSEMBLY OF CABLE AND CONNECTOR

(71) Applicant: CNPLUS Co., Ltd., Incheon (KR)

(72) Inventors: Jin Hwan Kim, Gyeonggi-do (KR); Sung Tae Kim, Incheon (KR)

(73) Assignee: CNPLUS Co., Ltd., Incheon (KR)

( * ) Notice: Subject to any disclaimer, the term of this patent is extended or adjusted under 35 U.S.C. 154(b) by 102 days.

(21) Appl. No.: 13/958,720

(22) Filed: Aug. 5, 2013

(65) Prior Publication Data

US 2014/0073166 A1 Mar. 13, 2014

(30) Foreign Application Priority Data

Sep. 7, 2012 (KR) ..... 10-2012-0099490

(51) Int. Cl.

| | |
|---|---|
| ***H01R 13/625*** | (2006.01) |
| ***H01R 12/24*** | (2006.01) |
| ***H01R 13/58*** | (2006.01) |
| ***H01R 12/77*** | (2011.01) |
| ***H01R 12/88*** | (2011.01) |

(52) U.S. Cl.

CPC ..... *H01R 13/5812* (2013.01); *H01R 12/772* (2013.01); *H01R 12/88* (2013.01)

(58) Field of Classification Search

CPC ..... H01R 12/79; H01R 12/88; H01R 12/774; H01R 12/592; H01R 12/57; H01R 12/772; H01R 13/6275; H01R 13/6273; H01R 43/26; H01R 13/4223

USPC ..... 439/260, 492, 495, 345

See application file for complete search history.

(56) References Cited

U.S. PATENT DOCUMENTS

| | | | | |
|---|---|---|---|---|
| 6,679,713 | B2 * | 1/2004 | Miura | 439/260 |
| 7,892,002 | B2 * | 2/2011 | Shen et al. | 439/260 |
| 8,337,230 | B1 * | 12/2012 | Kurachi | 439/328 |
| 8,660,915 | B2 * | 2/2014 | Giacobbe et al. | 705/28 |

FOREIGN PATENT DOCUMENTS

| | | |
|---|---|---|
| KR | 20-2000-0011169 | 6/2000 |
| KR | 10-2004 0016430 | 2/2004 |

* cited by examiner

*Primary Examiner* — Xuong Chung Trans

(57) ABSTRACT

The connector includes a housing, a plurality of contacts fixedly disposed in the housing, and a fitting nail disposed at least one side end portion of the housing. The fitting nail includes a base fixedly disposed at a longitudinal section of an internal space of the housing, and an elastic piece upwardly extending from the base and pressed toward the base by an external force. The fitting nail is positioned between the first and second extending members of the elastic piece and further includes a locking piece extending toward the cut-out portion in a state in which it is upwardly inclined from the front end portion of the base.

19 Claims, 13 Drawing Sheets

CONNECTOR, AND ASSEMBLY OF CABLE AND CONNECTOR

CROSS-REFERENCE TO RELATED APPLICATION

This application claims priority to and the benefit of Korean Patent Application No. 10-2012-0099490 filed on Sep. 7, 2012, which is herein incorporated by reference in its entirety.

BACKGROUND OF THE INVENTION

1. Field of the Invention

Aspects of the present invention relate to a connector and an assembly of a cable and the connector (to be referred to as a cable-connector assembly). More particularly, aspects of the present invention relate to a connector including a locking unit, a resilience unit and a guiding unit for a cable, and a cable-connector assembly.

2. Description of the Related Art

A connector used for ultrahigh speed transmission of data/signals is connected to a cable. In general, a board to wire type connector using a coaxial cable is widely used.

The board to wire type connector includes a header mounted on a printed circuit board, and a housing to which a cable is connected. The connecting of the cable to the housing is manually performed. Since the connector includes many parts and is manually assembled, the manufacturing cost of the connector is considerably high, which is undesirable in view of cost effectiveness.

In order to overcome the shortcoming of the cost-ineffective board to wire type connector, a connector electrically connected to a flexible flat cable (to be abbreviated as "FFC" hereinafter) is used.

FIG. 1 is a perspective view illustrating a general connector having a flexible flat cable (FFC) connected thereto. The illustrated connector 10 includes a housing 11 and a plurality of contacts 12 (to be also referred to as "terminals") fixedly installed in the housing 11. Each of the contacts 12 is made of a conductive material, that is, a metal.

A plurality of conductive patterns are formed on the FFC 20. When the FFC 20 is assembled with the connector 10, the respective conductive patterns of the FFC 20 make contact with the corresponding contacts 12 of the connector 10, thereby electrically connecting the FFC 20 to the connector 10.

Meanwhile, a board or a cable connected to a device (not shown) is electrically connected to the other side of the connector 10, thereby electrically connecting the FFC 20 and the device through the connector 10.

Fitting nails (not shown in FIG. 1) are mounted in longitudinal sections of opposite sides of the housing 11, respectively. The fitting nail reinforces the strength of the housing 11 and mechanically supports the contact 12.

An assembling process of the connector 10 and the FFC 20 will now be briefly described.

A longitudinal section of the FFC 20 is inserted into the housing 11 of the connector 10 to be positioned between two contact pieces of each of the contacts 12 of the connector 10, and an actuator (not shown) installed on the housing 11 of the connector 10 is then actuated to press the longitudinal section of the FFC 20. Therefore, the longitudinal section of the FFC 20, that is, a region where conductive patterns are formed, makes contact with each of the contacts 12 of the connector 10, thereby establishing electrical and mechanical connection between the FFC 20 and the connector 10.

In general, the fitting nail just performs functions of reinforcing the strength of the housing 11 and mechanically supporting the contact 12 but does not perform a function associated with the FFC 20.

In a state in which the actuator presses the longitudinal section of the FFC 20 to allow the region of the FFC 20, where conductive patterns are formed, to make contact with each of the contacts 12 of the connector 10, when an external force is applied to the FFC 20 or the connector 10 in a horizontal direction (i.e., parallel to the FFC 20), a connection between the FFC 20 and each of the contacts 12 of the connector 10 may be easily canceled, so that the electrical and mechanical connection between the FFC 20 and the connector 10 is not maintained.

Meanwhile, there is no constitutional member for guiding the longitudinal section of the FFC 20 to be inserted into the housing 11 of the connector 10. Thus, it is quite difficult to achieve an accurate connection between the connector 10 that is small in size and the FFC 20 that is slim.

SUMMARY OF THE INVENTION

Aspects of the present invention provide a connector, which can continuously maintain a coupling state (a locking structure) of an external cable and the connector even when an unintended external force is applied to the FFC after the external cable and the connector are connected, and a cable-connector assembly.

Other aspects of the present invention provide a connector, which is configured such that an external cable is accurately positioned in a housing of the connector by guiding entry of the external cable into the connector while the connector and the external cable are assembled to each other, and a cable-connector assembly.

In accordance with one aspect of the present invention, there is provided a connector including a housing, a plurality of contacts fixedly disposed in the housing, and a fitting nail disposed at least one side end portion of the housing, wherein the fitting nail includes a base fixedly disposed at an end portion of an internal space of the housing, and an elastic piece upwardly extending from the base and pressed toward the base by an external force.

The elastic piece may include first and second extending members upwardly extending from a front end portion of the base and spaced apart from each other; and a connecting member connecting front ends of the first and second extending members. Here, the connecting member may have a part which is opposite to a part corresponding to the front end portion of the base, and is downwardly inclined toward a cut-out portion formed on the base.

The fitting nail may further include a locking piece positioned between the first and second extending members of the elastic piece and extending toward the cut-out portion in a state in which it is upwardly inclined from the front end portion of the base.

In addition, the fitting nail may further include a guide piece disposed at the exterior side of the elastic piece to be parallel with the elastic piece.

Alternatively, the elastic piece may extend from the front end portion of the base toward the cut-out portion and may have a free end downwardly inclined toward the cut-out portion. Here, a top surface of the free end portion of the elastic piece may be recessed over the entire width thereof. The fitting nail having the elastic piece may further include a locking piece extending toward the cut-out portion in a state in which it is upwardly inclined from the front end portion of the base.

In accordance with another aspect of the present invention, there is provided an assembly of a cable and a connector, the cable-connector assembly including a connector; an actuator mounted on the connector; and a cable electrically and mechanically connected to the connector, wherein the connector comprises a housing, a plurality of contacts fixedly disposed in the housing, and a fitting nail disposed at least one side end portion of the housing, wherein the fitting nail includes a base fixedly disposed at a longitudinal section of an internal space of the housing, and an elastic piece upwardly extending from the base and pressed toward the base by an external force.

The fitting nail of the connector constituting the cable-connector assembly may have the same configuration as described above.

Here, the cable may have a plurality of conductive patterns formed at its front end, and when it is pressed by the actuator, a side end portion of the cable presses the elastic piece of the fitting nail to allow the conductive patterns to make contact with contacts of the connector.

In addition, the fitting nail may be positioned on the base and may further include a guide piece disposed at the exterior side of the elastic piece to be parallel with the elastic piece to guide the cable to be inserted into the connector.

The cable may include a base member having conductive patterns formed at its front ends and an opening formed at the front end portion of at least one side; and upper and lower reinforcement members attached to upper and lower portions of the base member, wherein parts of front ends of the upper and lower reinforcement members are removed to allow the conductive patterns of the base member to be exposed to the outside.

Openings may be formed on the base member and front ends of the side portions of the upper and lower reinforcement members, these openings form a single opening into which the locking piece of the fitting nail is inserted when the base member and the upper and lower reinforcement members are adhered to each other.

In addition, one or more thin metal sheet regions may be disposed at one or more side portions of the upper and lower reinforcement members of the cable, and one or more bonding openings may be formed at one or more side portions of the base member, so that the metal sheet regions formed at the lower reinforcement member and the upper reinforcement member are allowed to correspond to each other through the bonding openings of the base member. In this state, the upper reinforcement member, the base member and the lower reinforcement member may be integrally bonded by welding the metal sheet regions.

As described above, in the cable-connector assembly, a coupling state (a locking structure) of an external cable and the connector can be continuously maintained even when an unintended external force is applied after the external cable and the connector are connected.

In addition, an external cable is accurately positioned in a housing of the connector by guiding insertion of the external cable into the connector while the connector and the external cable are assembled to each other.

Additional aspects and/or advantages of the invention will be set forth in part in the description which follows and, in part, will be obvious from the description, or may be learned by practice of the invention.

BRIEF DESCRIPTION OF THE DRAWINGS

The above and other features and advantages will become more apparent to those of ordinary skill in the art by describing in detail exemplary embodiments with reference to the attached drawings, in which:

FIGS. 5A and 5B are cross-sectional views taken along the line "A-A" of FIG. 2, in which FIG. 5A illustrates a state before an actuator is actuated when a fitting nail and a cable are connected to each other, and FIG. 5B illustrates a state after an actuator is actuated;

In the following description, the same or similar elements are labeled with the same or similar reference numbers.

DETAILED DESCRIPTION

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferred embodiments of the present disclosure will be described in detail with reference to the accompanying drawings in such a manner that the technical idea of the present disclosure may easily be carried out by a person with ordinary skill in the art to which the invention pertains. Objects, operations, effects, other objects, characteristics and advantages of the present disclosure will be easily understood from an explanation of a preferred embodiment that will be described in detail below by reference to the attached drawings.

Although embodiments have been described with reference to illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

Figure 2:
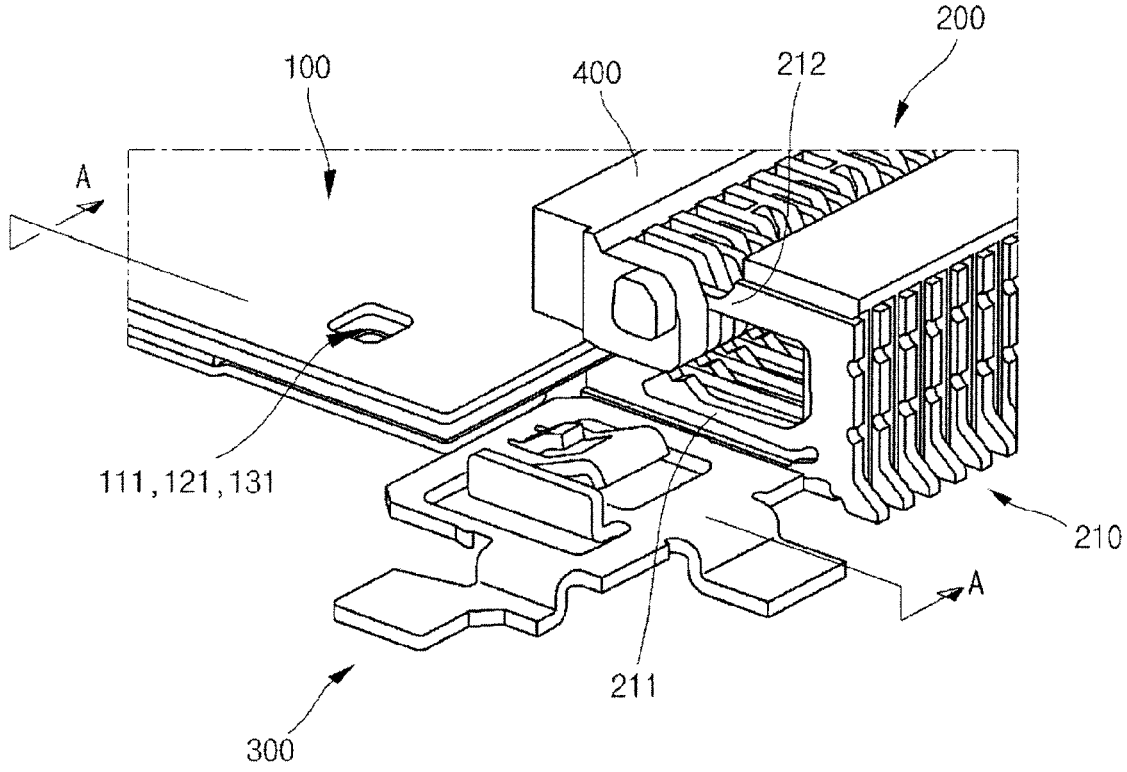
FIG. 2 illustrates a state in which a connector and a cable constituting a cable-connector assembly according to the present invention are disconnected from each other.

FIG. 2 illustrates a state in which a connector and a cable constituting a cable-connector assembly according to the present invention are disconnected from each other. In FIG. 2, only some parts of the connector 200 and some parts of an external cable 100 (for example, a flexible flat cable (to be abbreviated as "FFC" hereinafter) are shown. For brevity, FIG. 2 illustrates the connector 200 from which a housing is eliminated.

Figure 1:
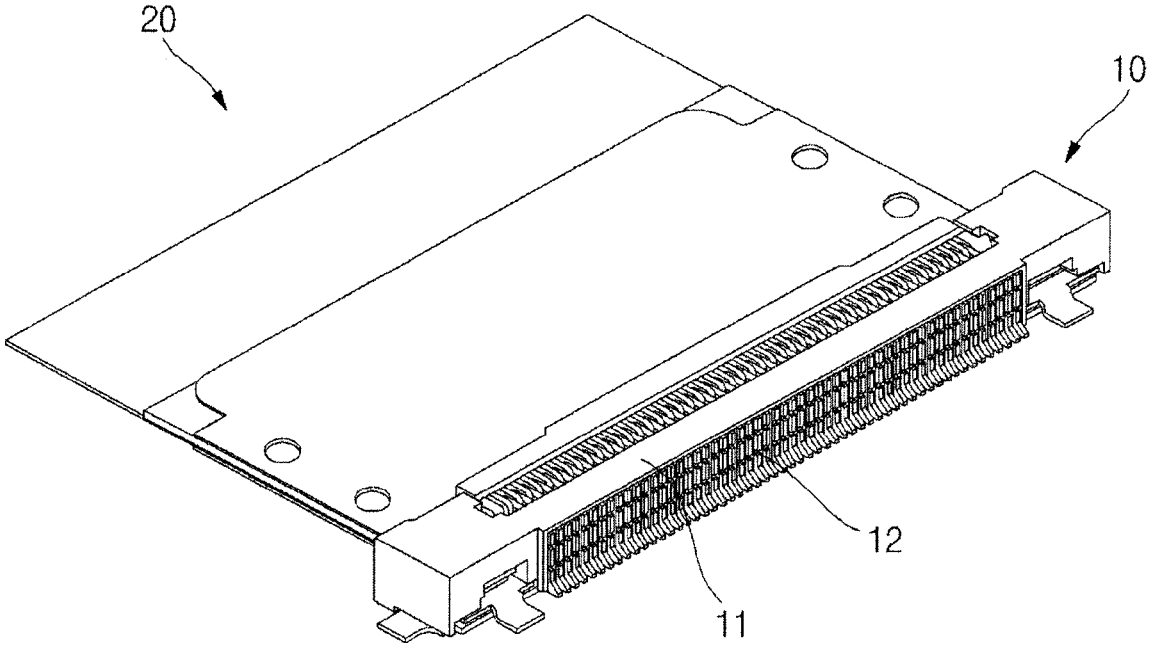
FIG. 1 illustrates a state in which an FFC and a connector are connected to each other.

Here, the connector 200 has a substantially the same configuration as that of the connector 10 shown in FIG. 1. In other words, the connector 200 according to the present invention includes a housing (not shown in FIG. 2 but has a configuration similar to the that of the housing 11 shown in FIG. 1) and a plurality of contacts 210 fixedly disposed in the housing, each of the contacts 210 is formed of a conductive material, that is, metal.

In addition, fitting nails 300 are mounted at both side end portions of the housing 210 of the connector 200, respectively. The two fitting nails 300 have the same configuration and are arranged in both side end portions of the housing 210 in a mirror-symmetrical state.

Each of the contacts 210 of the connector 200 includes first and second contact pieces 211 and 212 horizontally extending to be parallel to each other, and the FFC 100 is inserted into a space formed between the first and second contact pieces 211 and 212 of each of the contacts 210. In FIG. 2, undefined reference numeral "400" denotes an actuator constituting the connector 200, which downwardly presses the FFC 100 inserted between the first and second contact pieces 211 and 212 of each of the contacts 210.

Figure 3A:
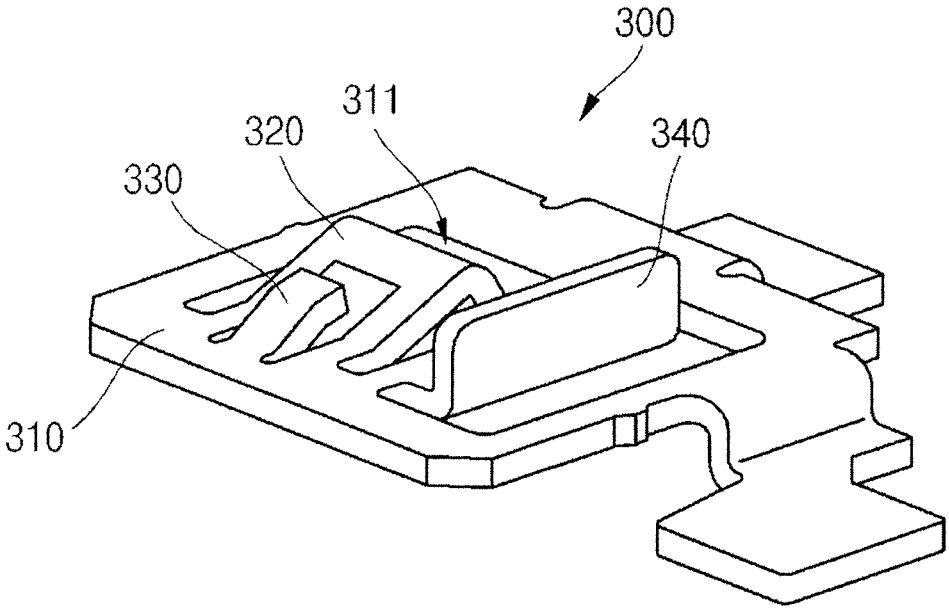
FIGS. 3A, 3B and 3C are a perspective view, a plan view and a side view illustrating an embodiment of a fitting nail of a connector according to the present invention, respectively.
Figure 3B:
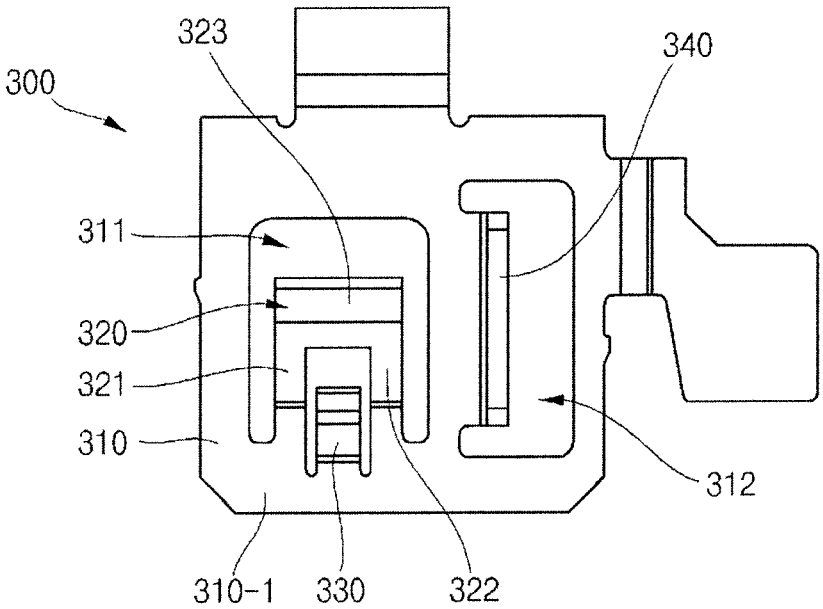
Figure 3C:
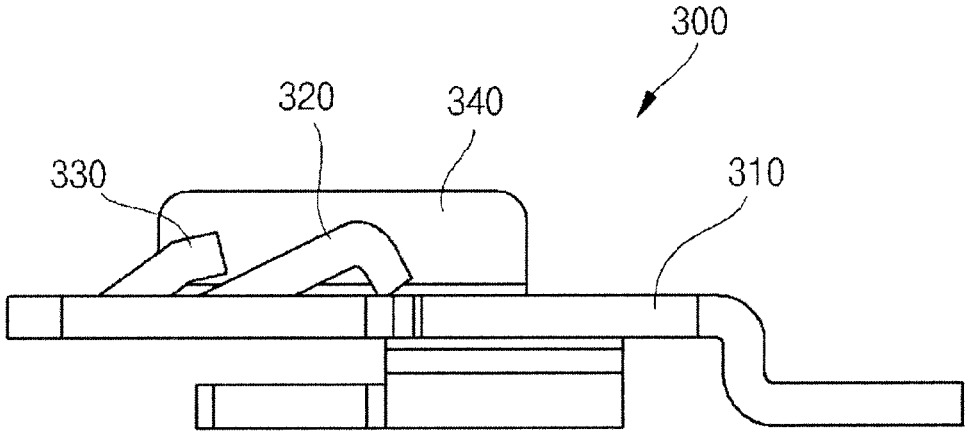

FIGS. 3A, 3B and 3C are a perspective view, a plan view and a side view illustrating one of fitting nails 300 constituting the connector (200) according to the present invention.

The fitting nail 300 includes a base 310, an elastic piece 320, a locking piece and a guide piece 340, each of which being formed on the base 310.

The base 310 is a member having a predetermined area, and is fixedly installed at a side end portion in the internal space of the housing of the connector 200. As shown in FIG. 2, the base 310 is disposed such that one side end portion is adjacent to the outermost one of the plurality of contacts 210 disposed in the internal space of the housing.

Meanwhile, in the description, in view of the inserted direction of the FFC 100, a part first faced by the inserted FFC 100 is defined as "front end" and a direction directed toward the FFC 100 is defined as an "upward direction".

First and second cut-out portions 311 and 312 are formed on the base 310, the elastic piece 320 and the locking piece 330 are arranged to correspond to the first cut-out portion 311, and the guide piece 340 is arranged to correspond to the second cut-out portion 312.

The elastic piece 320 includes first and second extending members 321 and 322 extending from a front end portion 310-1 of the base 310 toward the first cut-out portion 311 to be parallel to each other and a connecting member 323 connecting front ends of the first and second extending members 321 and 322. Therefore, the first and second extending members 321 and 322 and the connecting member 323 correspond to the first cut-out portion 311.

The first and second extending members 321 and 322 are upwardly inclined from the front end portion 310-1 of the base 310 toward the connecting member 323. In particular, the first and second extending members 321 and 322 are gently inclined without bent portions. Meanwhile, a center portion of the connecting member 323 is downwardly bent, so that a rear end portion of the connecting member 323 (that is, a portion which is opposite to a portion corresponding to the front end portion 310-1 of the base 310) is downwardly tilted toward the first cut-out portion 311.

The locking piece 330 is positioned between the first and second extending members 321 and 322 of the elastic piece 320. In other words, the locking piece 330 extends from the front end portion 310-1 of the base 310 between the first and second extending members 321 and 322 of the elastic piece 320 toward the first cut-out portion 311. Unlike the elastic piece 320, the locking piece 330 includes only an upwardly inclined portion. In addition, as shown in FIG. 3A, a boundary portion between the locking piece 330 and the front end portion 310-1 of the base 310 is divided by a bent portion.

A guide piece 340 is formed at a region adjacent to the first cut-out portion 311, that is, at an outer side of the elastic piece 320. That is to say, the guide piece 340 having a certain height and a length toward the inserted direction of the FFC 100 is formed at an internal edge of the second cut-out portion 312.

Figure 4A:
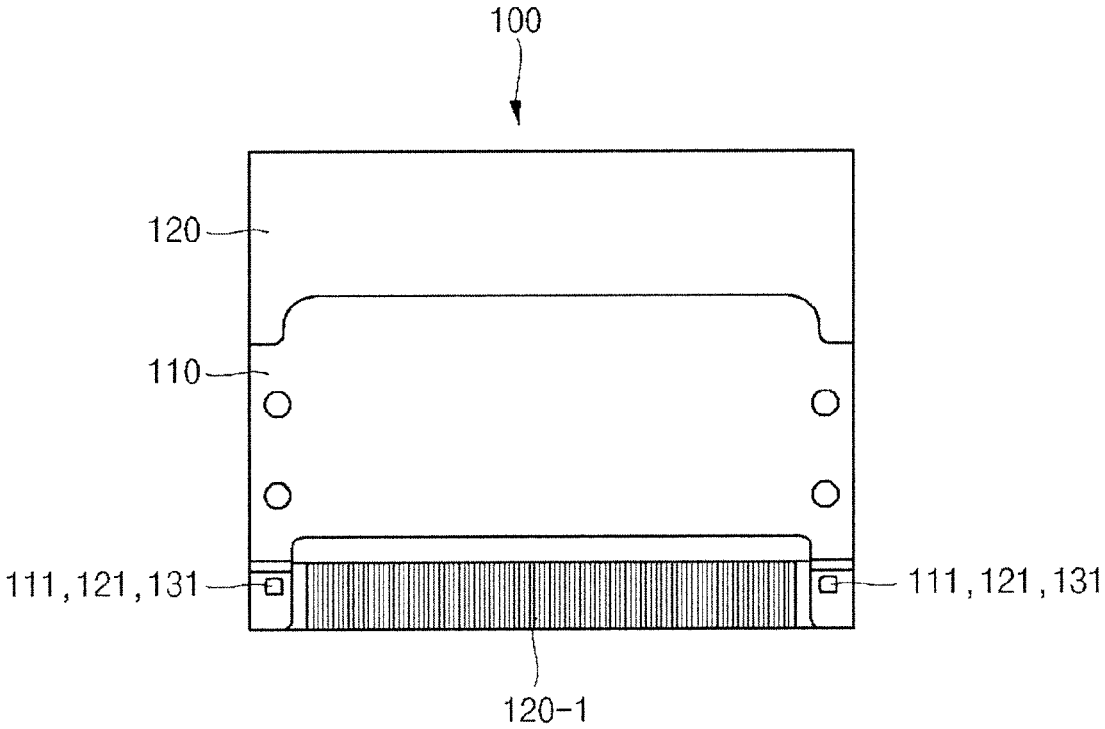
FIGS. 4A and 4B are a plan view and an exploded a perspective view illustrating a cable constituting the cable-connector assembly according to the present invention.
Figure 4B:
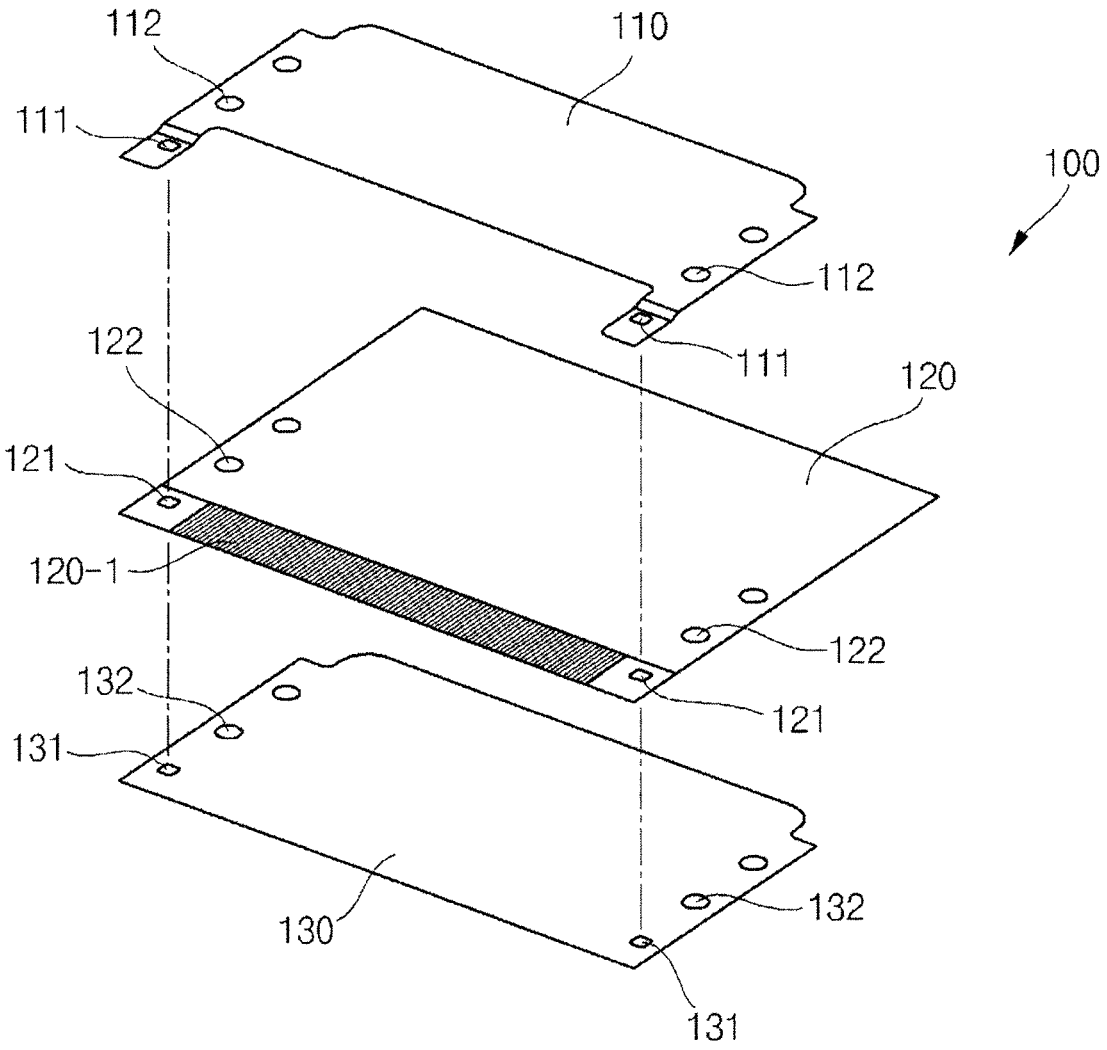

FIGS. 4A and 4B are a plan view and an exploded a perspective view illustrating a cable constituting the cable-connector assembly according to the present invention.

The FFC 100 includes a base film 120 acting as a base member and having conductive patterns 120-1 formed on some area thereof and upper and lower reinforcement members 110 and 130 attached to upper and lower sides of the base film 120. The base film 120 and the upper and lower reinforcement members 110 and 130 correspond to each other.

Here, some portions of front ends of the upper and lower reinforcement members 110 and 130 are removed. Thus, in the finally obtained FFC 100, the conductive patterns 120-1 formed at the front end portion of the base film 120 (a portion corresponding to the connector 200 before being assembled) are exposed to the outside and become in contact with contacts 210 of the connector 200.

Openings 121, 111 and 131 having a certain size are formed on the front ends of opposite sides of the base film 120, the upper and lower reinforcement members 110 and 130. The openings 121, 111 and 131 correspond to one another. Therefore, when the base film 120 and the upper and lower reinforcement members 110 and 130 are adhered to each other to assemble the FFC 100, the openings 121, 111 and 131 form a single opening, as shown in FIG. 4A.

The process of electrically and mechanically connecting the aforementioned connector 200 to the FFC 100 will now be described in detail.

Figure 5A:
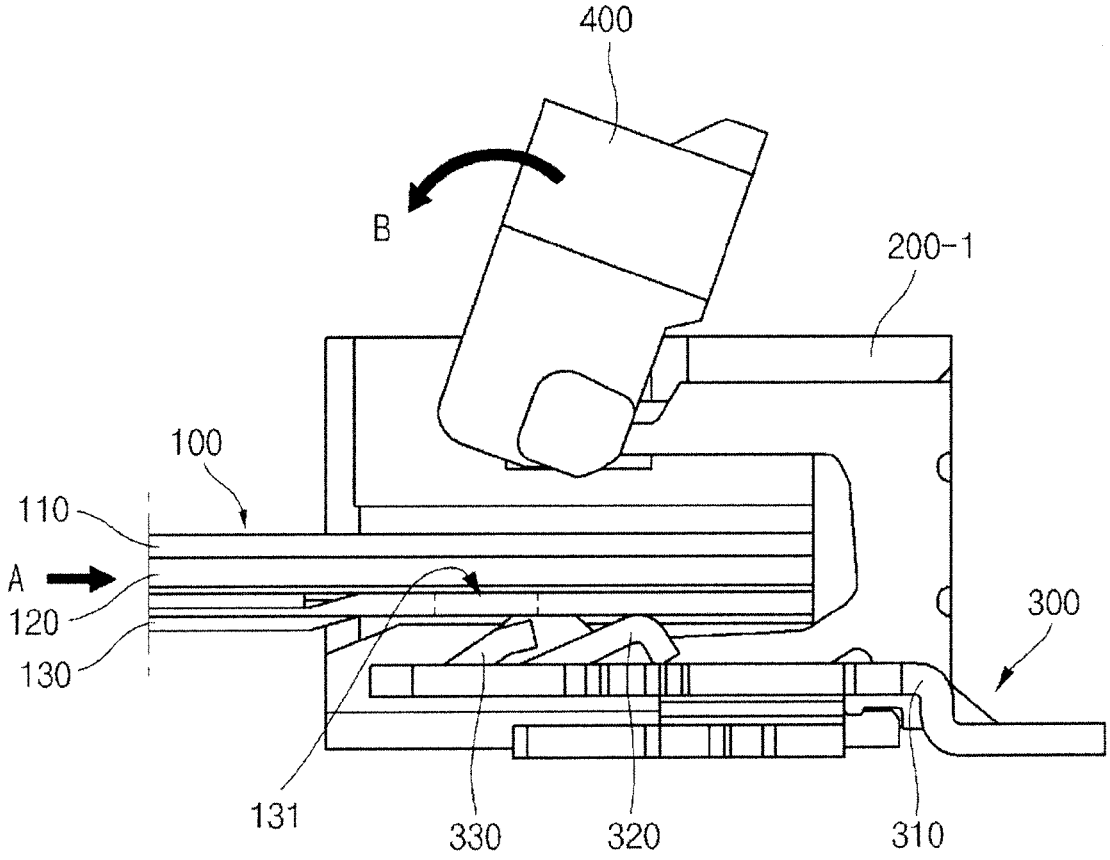
Figure 5B:
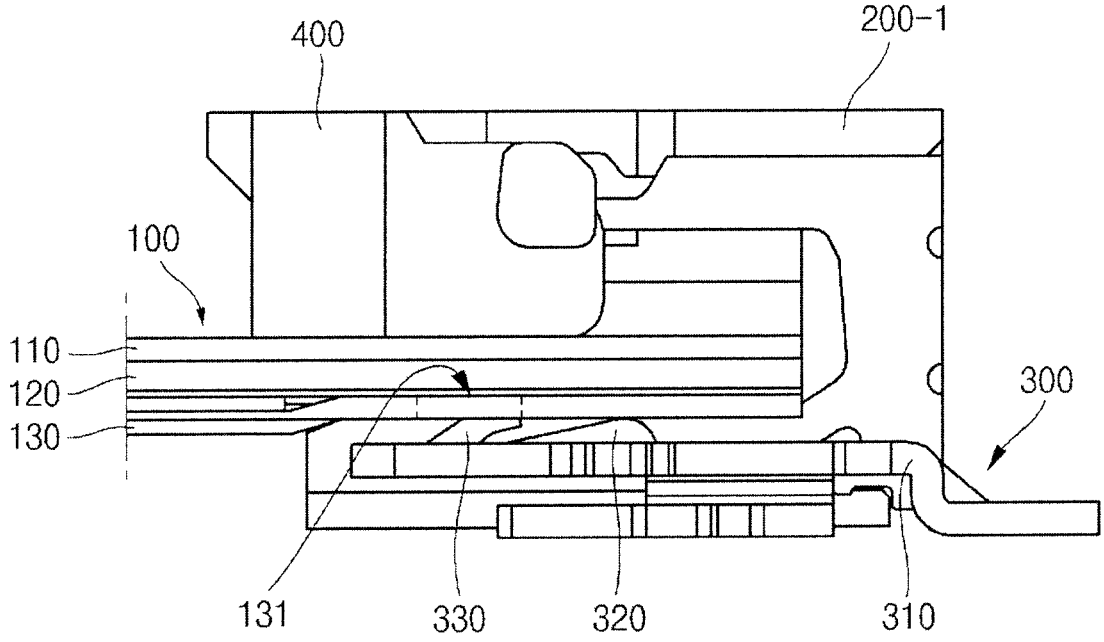

FIGS. 5A and 5B are cross-sectional views taken along the line "A-A" of FIG. 2, FIG. 5A illustrates a state before an actuator is actuated when the fitting nail and the cable are connected to each other, and FIG. 5B illustrates a state after an actuator is actuated.

If the FFC 100 is inserted into the housing 200-1 of the connector 200 (in a direction indicated by the arrow "A" of FIG. 5A), the conductive patterns 120-1 formed on the front end portion of the base film 120 constituting the FFC 100 are inserted into a space formed between the first and second contact pieces 211 and 212 of each of the contacts 210 constituting the connector 200 (not shown in FIGS. 5A and 5B, but shown in FIG. 2). At this time, the opposite sides of the FFC 100 are positioned on the fitting nails 300 in the housing 200-1 of the connector 200 (the state shown in FIG. 5A).

Meanwhile, at an early stage in which the FFC 100 is inserted into the housing 200-1 of the connector 200, opposite edges of the FFC 100 make contact with the inner surface of the guide piece 340 of the fitting nail 300. Therefore, the FFC 100 is guided along the guide piece 340 of the fitting nail 300 and can be accurately inserted into the housing 200-1 of the connector 200.

In a state in which the FFC 100 is completely inserted into the housing 200-1 of the connector 200 (that is, in the state as shown in FIG. 5A), if the actuator 400 mounted on the housing 200-1 of the connector 200 is rotated with respect to an axis (in a direction indicated by the arrow "B" of FIG. 5A), the actuator 400 is locked to the housing 200-1 of the connector 200 and its end portion presses downwardly the FFC 100. Therefore, the FPC 100, that is, the conductive patterns 120-1 formed on the front end portion of the base film 120 are securely contacted with the contacts 210 of the connector 200.

Meanwhile, the FFC 100 pressed by the actuator 400 presses downwardly the elastic piece 320 of the fitting nail 300 toward the first opening 311. Therefore, at least a portion of the elastic piece 320 of the fitting nail 300 is positioned in the first opening 311 in a state in which it is pressed about the front end portion 310-1 of the base 310.

At the same time, in a state in which the locking piece 330 is not pressed, the locking piece is inserted into an opening formed at the front end portion of either side of the FFC 100 pressed by the actuator 400, for example, the opening 131 formed on the lower reinforcement member 130 (in a state as shown in FIG. 5B). As shown in FIG. 5B, a front end surface of the locking piece 330 is in contact with a surface adjacent to the opening 131 of the FFC 100. Accordingly, even when an unintended external force is applied to the FFC 100 (in a direction opposite to the direction indicated by the arrow "A" of FIG. 5A), the coupling state between the FFC 100 and the housing 200-1 of the connector 200 is not released.

In order to disconnect the FFC 100 from the connector 200, if an operator may rotate the actuator 400 in a reverse direction (that is, in a direction opposite to the direction indicated by the arrow "B" of FIG. 5A), a pressure applied to the FFC 100 is eliminated, and the elastic piece 320 of the fitting nail 300 upwardly pushes the FFC 100 with a restoring force, whereby the locking piece 330 of the fitting nail 300 is escaped from the opening 131 of the FFC 100.

Thereafter, if the operator pulls the FFC 100 in the direction opposite to the direction indicated by the arrow "A" of FIG. 5A, the coupling state between the FFC 100 and the housing 200-1 of the connector 200 is released.

Meanwhile, as shown in FIG. 4B, multiple thin metal sheet regions 112 and 132 are disposed at opposite side portions of the upper and lower reinforcement members 110 and 130 constituting the FFC 100, and multiple bonding openings 122 are formed at opposite side portions of the base film 120.

As shown in FIG. 4B, in a state in which the upper reinforcement member 110, the base film 120 and the lower reinforcement member 130 are stacked one on the other, the metal sheet regions 112 and 132 formed on the upper and lower reinforcement members 110 correspond to each other through the bonding openings 122 formed on the base film 120.

In this state, the metal sheet regions 112 and 132 of the upper and lower reinforcement members 110 and 130 are integrally bonded to each other by welding the metal sheet regions 112 and 132 of the upper and lower reinforcement members 110 and 130, thereby finally obtaining the FFC 100.

Here, the elastic piece 320, the locking piece 330 and the guide piece 340 of the fitting nail 300 may be formed and arranged in a variety of combinations. In other words, only at least one of the elastic piece 320, the locking piece 330 and the guide piece 340 may be formed on the base 310. Conversely, all of the elastic piece 320, the locking piece 330 and the guide piece 340 may be formed on the base 310.

In the above description, the FFC is exemplified, but a flexible printed circuit board may also be used as the external cable 100.

Meanwhile, a constitutional member for accurately connecting the external cable to the connector may further be provided in the cable-connector assembly according to the present invention.

Figure 6A:
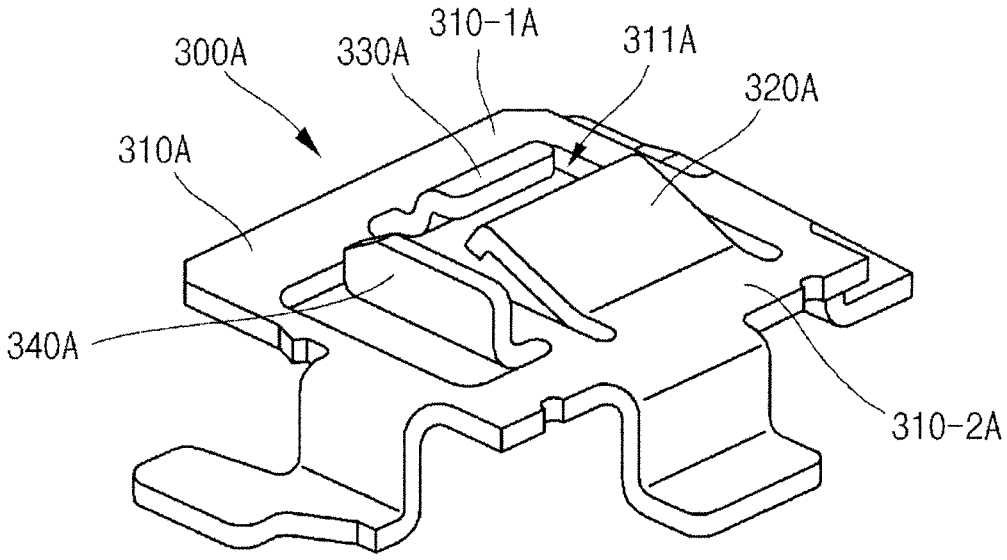
FIGS. 6A, 6B and 6C are a perspective view, a plan view and a side view illustrating a fitting nail of a connector according to another embodiment of the present invention, respectively.
Figure 6B:
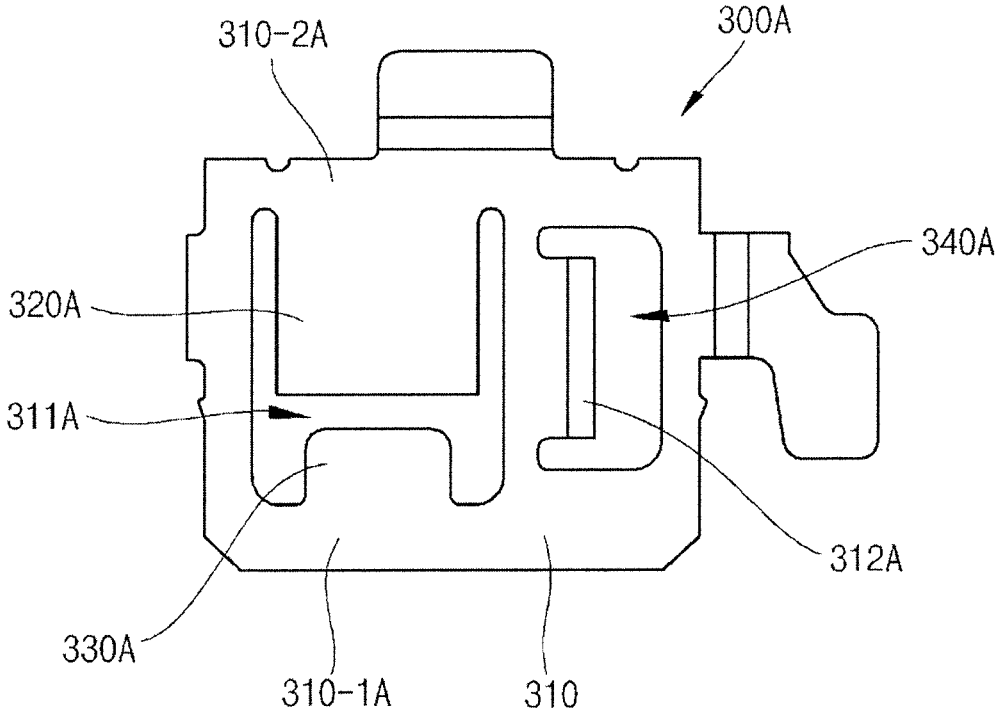
Figure 6C:
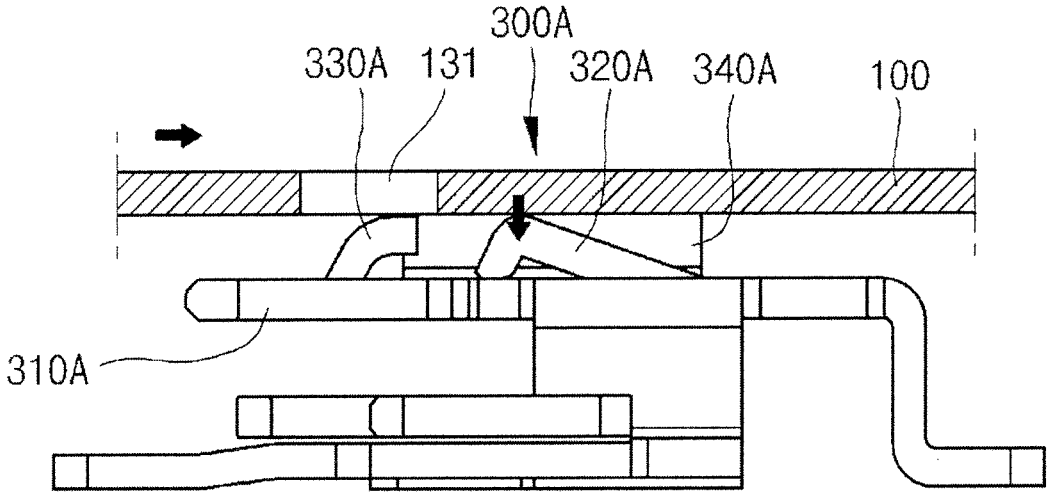

FIGS. 6A, 6B and 6C are a perspective view, a plan view and a side view illustrating a fitting nail constituting a connector according to another embodiment of the present invention, respectively.

A fitting nail 300A according to this embodiment of the present invention includes a base 310A, and an elastic piece 320A, a locking piece 330A and a guide piece 340A formed on the base 310A.

The base 310A is a member having a certain area, and is fixedly installed at a side end portion in the internal space of a housing of the connector 200. In other words, one side end portion of the base 310A is adjacent to the outermost one of a plurality of contacts disposed in the internal space of the housing (The base 310A is arranged in the same manner as the fitting nail 300 shown in FIG. 2.).

Meanwhile, in the following description, in view of the inserted direction of the FFC (100 of FIG. 2), a portion first faced by the inserted FFC 100 is defined as "front end portion" and a direction directed toward the FFC 100 is defined as an "upward direction."

First and second cut-out portions 311A and 312A are formed on the base 310A. The elastic piece 320A and the locking piece 330A are arranged to correspond to the first cut-out portion 311A, and the guide piece 340A is arranged to correspond to the second cut-out portion 312A.

The elastic piece 320A is a part extending from a rear end portion 310-2A of the base 310A to the first cut-out portion 311A. The elastic piece 320A is upwardly inclined from the rear end portion 310-2A of the base 310A toward the front end portion 310-1A. In particular, the elastic piece 320A is gently inclined without a bent portion.

Meanwhile, some of a front end portion of the elastic piece 320A is downwardly bent. Therefore, the front end portion of the elastic piece 320A (that is, a portion corresponding to the front end portion 310-1A of the base 310A) is downwardly inclined toward the first cut-out portion 311A. Preferably, an upper surface of the front end portion of the elastic piece 320A has a curved shape over the entire width thereof.

The locking piece 330A is formed at an opposite region of the elastic piece 320A with the first cut-out portion 311A positioned therebetween. In other words, the locking piece 330A extends from the rear end portion 310-1A of the base 310A toward the first cut-out portion 311A. The locking piece 330A is upwardly inclined from the front end portion 310-1A of the base 310A toward the rear end portion 310-2A. In particular, the locking piece 330A is gently inclined without a bent portion.

The guide piece 340A is formed at a region adjacent to the first cut-out portion 311A, that is, at exterior sides of the elastic piece 320A and the locking piece 330A. In other words, the guide piece 340A having a certain height and a length toward the inserted direction of the FFC 100 is formed at an inside edge of the second cut-out portion 312A.

The process of coupling the FFC 100 to the connector 200 having the aforementioned fitting nail 300A will now be described in detail with reference to FIGS. 5A, 6A, 6B and 6C. In FIG. 6C, the FFC 100 to be coupled to a housing is indicated by a section with oblique lines and the housing of the connector is not shown.

At an early stage in which the FFC 100 is inserted into the housing (200-1 of FIG. 5A) of the connector (200 of FIG. 5A) (in the direction indicated by the arrow shown in FIGS. 6A and 6C), a side edge of the FFC 100 becomes in contact with the inside surface of the guide piece 340A of the fitting nail 300A. Therefore, the FFC 100 is guided along the guide piece 340A of the fitting nail 300A and is accurately inserted into the housing (200-1 of FIG. 5A) of the connector (200 of FIG. 5A). Meanwhile, while the FFC 100 is inserted into the housing (200-1 of FIG. 5A) of the connector (200 of FIG. 5A), a bottom surface of the FFC 100 is in contact with a curved upper surface of a front end portion of the elastic piece 320A, so that the FFC 100 can be inserted without any resistance.

In a state in which the FFC 100 is completely inserted into the housing (200-1 of FIG. 5A) of the connector (200 of FIG. 5A) (in the same state as shown in FIG. 5A), if the actuator (400 of FIG. 5A) mounted on the housing (200-1 of FIG. 5A) of the connector (200 of FIG. 5A) is rotated with respect to an axis (in the direction indicated by the arrow "B" of FIG. 5A), the actuator (400 of FIG. 5A) is locked to the housing (200-1 of FIG. 5A) of the connector (200 of FIG. 5A) and an end portion of the actuator downwardly presses the FFC 100.

As described above, the FFC 100 pressed by the actuator (400 of FIG. 5A) downwardly presses the elastic piece 320A of the fitting nail 300A toward a first opening 311A. Therefore, in a state in which the elastic piece 320A of the fitting nail 300A is pressed about the rear end portion 310-2A of the base 310A, the elastic piece 320A of the fitting nail 300A is partially or completely positioned in the first opening 311A.

At the same time, in a state in which the locking piece 330A is not pressed, the locking piece is inserted into an opening formed at the front end portion of either side of the FFC 100 pressed by the actuator 400, for example, the opening 131 formed on the lower reinforcement member (130 of FIG. 4B) (in a state as shown in FIG. 6C).

As shown in FIG. 6C, a front end surface of the locking piece 330A is in contact with a surface adjacent to the opening 131 of the FFC 100. Accordingly, even if an unintended external force is applied to the FFC 100 (in the direction opposite to the direction indicated by the arrow "A" of FIG. 5A), the coupling state between the FFC 100 and the housing 200-1 of the connector 200 is not released.

In order to disconnect the FFC 100 from the connector 200, an operator may rotate the actuator 400 in a reverse direction (that is, in the direction opposite to the direction indicated by the arrow "B" of FIG. 5A). Then, as a pressure applied to the FFC 100 is removed, the elastic piece 320A of the fitting nail 300A upwardly pushes the FFC 100 with its restoring force, so that the locking piece 330A of the fitting nail 300A is escaped from the opening 131 of the FFC 100.

Thereafter, if the operator pulls the FFC 100 in the direction opposite to the direction indicated by the arrow "A" of FIG. 5A, the coupling state between the FFC 100 and the connector 200 is released.

Figure 7A:
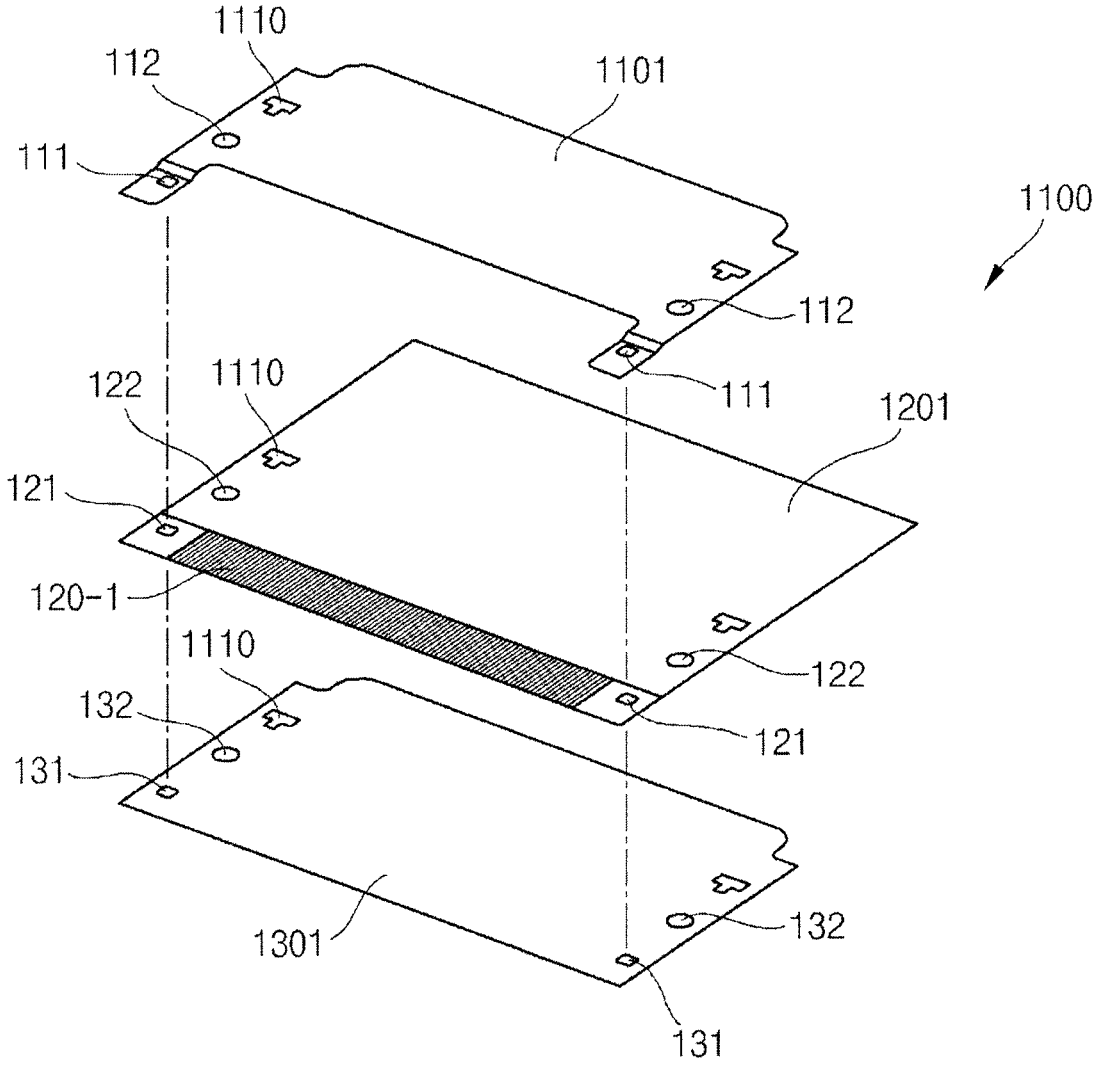
FIG. 7A corresponds to FIG. 4B and is a perspective view of an FFC of a cable-connector assembly according to another embodiment of the present invention.

FIG. 7A corresponds to FIG. 4B and is a perspective view of an FFC of a cable-connector assembly according to another embodiment of the present invention. Here, the same elements as those of the FFC shown in FIG. 4B are denoted by the same reference numerals.

Figure 8:
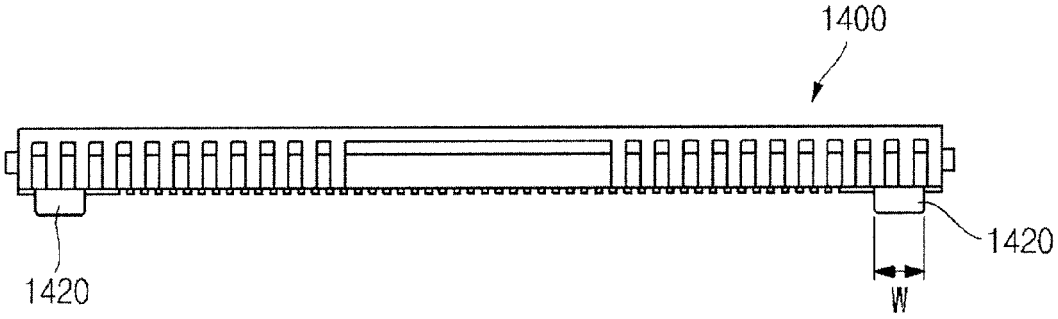
FIG. 8 is a front view of an actuator of the cable-connector assembly according to according to another embodiment of the present invention.

FIG. 8 is a front view of an actuator of the cable-connector assembly according to another embodiment of the present invention.

Meanwhile, the configurations and functions of the FFC and the actuator shown in FIGS. 7A and 8 are the same as those of the FFC and the actuator shown in FIGS. 2 to 5. Therefore, in the following description, only the added elements in this embodiment will be described.

As shown in FIG. 7A, guide openings 1110 (for brevity, the guide openings formed on the respective component are denoted by the same reference numeral) are formed on opposite side portions of a base member 1201, upper and lower reinforcement members 1101 and 1301 constituting the FFC 1100 according to the present embodiment.

Figure 7B:
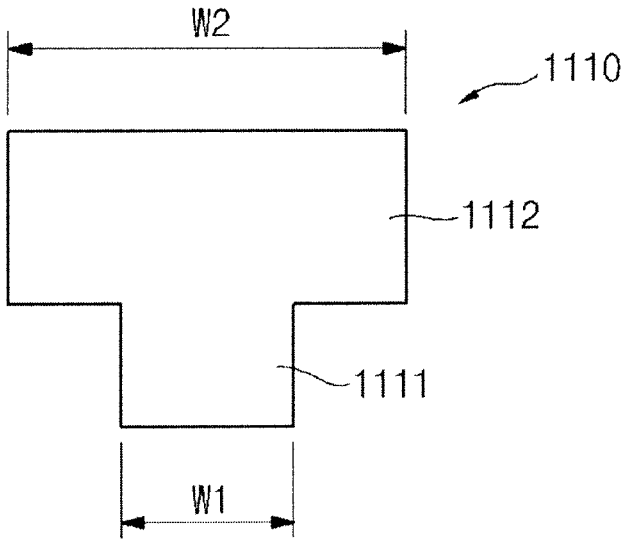
FIG. 7B is a detail view of a guide opening formed on the cable shown in FIG. 7A.

FIG. 7B is an enlarged view of the guide opening 1110 shown in FIG. 7A. Each of the guide openings 1110 is divided into a first region 1111 formed at its front end and a second region 1112 formed at its rear end to be led to the first region 1111.

As shown in FIG. 7B, a width W2 of the second region 1112 is substantially the same as a width of an insertion piece formed on the actuator described later, and the width W1 of the first region 1111 is smaller than the width W2 of the second region 1112.

As shown in FIG. 8, an insertion piece 1420 having a certain height and width is formed on a bottom surface of either edge of a main body 1410 of the actuator 1400. The insertion piece 1420 is perpendicular to the main body 1410.

As described above, the insertion piece 1420 of the actuator 1400 has the same width W and length as the width W2 and length of the second region 1112 of the guide opening 1110 formed at the side portion of the FFC 1100.

In order to electrically connect the FFC 1100 to the connector (200 of FIGS. 2 to 5), in a state in which the FFC 1100 is completely inserted into the housing of the connector 200 (that is, in the state as shown in FIG. 5A), if the actuator 1400 mounted on the housing of the connector 200 is rotated with respect to an axis (in the direction indicated by the arrow "B" of FIG. 5A), the end portion of the actuator 1400 downwardly presses the FFC 1100.

Figure 7C:
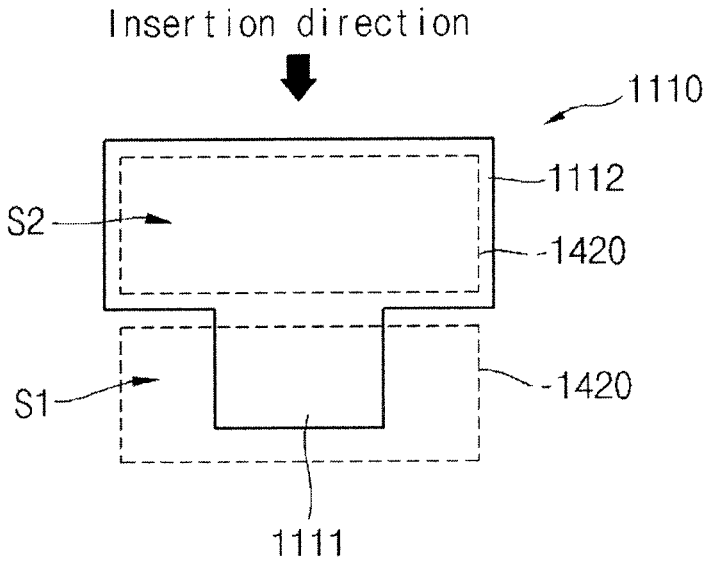
FIG. 7C corresponds to FIG. 7B and illustrates a state in which a guide opening formed on the cable and an insertion piece of the actuator correspond to each other.

In a case where the FFC 1100 is not completely inserted into the housing of the connector 200, when the actuator 1400 is rotated, the insertion piece 1420 of the actuator 1400 corresponds to the first region 1111 of the guide opening 1110 of the FFC 1100 (the state S1 in FIG. 7C).

As described above, since the width W1 of the first region 1111 of the guide opening 1110 of the FFC 1100 is smaller than the width W of the insertion piece 1420 of the actuator 1400, in such state, the insertion piece 1420 of the actuator 1400 is not inserted into the guide opening 1110 of the FFC 1100, so that the actuator 1400 is not locked with the housing of the connector 200.

In such a state, if the user pushes and completely inserts the FFC 1100 into the housing of the connector 200, the insertion piece 1420 of the actuator 1400 corresponds to the second region 1112 of the guide opening 1110 of the FFC 1100 (the state S2 in FIG. 7C).

The width W2 of the second region 1112 of the guide opening 1110 of the FFC 1100 is equal to the width W of the insertion piece 1420 of the actuator 1400. Therefore, in such a state, the insertion piece 1420 of the actuator 1400 is inserted into the guide opening 1110 of the FFC 1100, so that the actuator 1400 is locked with the housing of the connector.

Figure 9A:
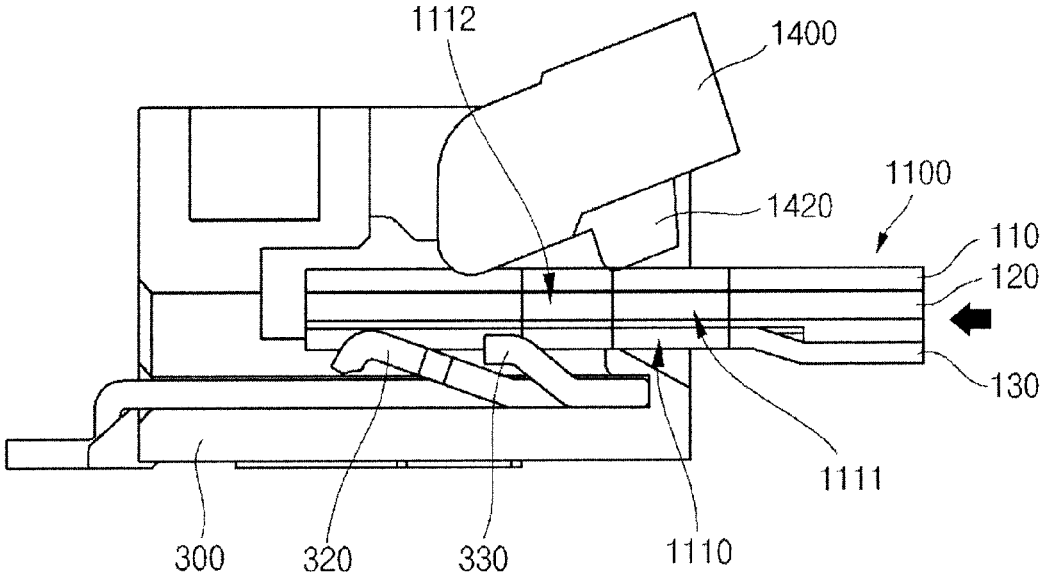
FIGS. 9A and 9B are partially side views illustrating relationships between the insertion piece of the actuator and the guide opening of the FFC shown in FIGS. 7A and 8.
Figure 9B:
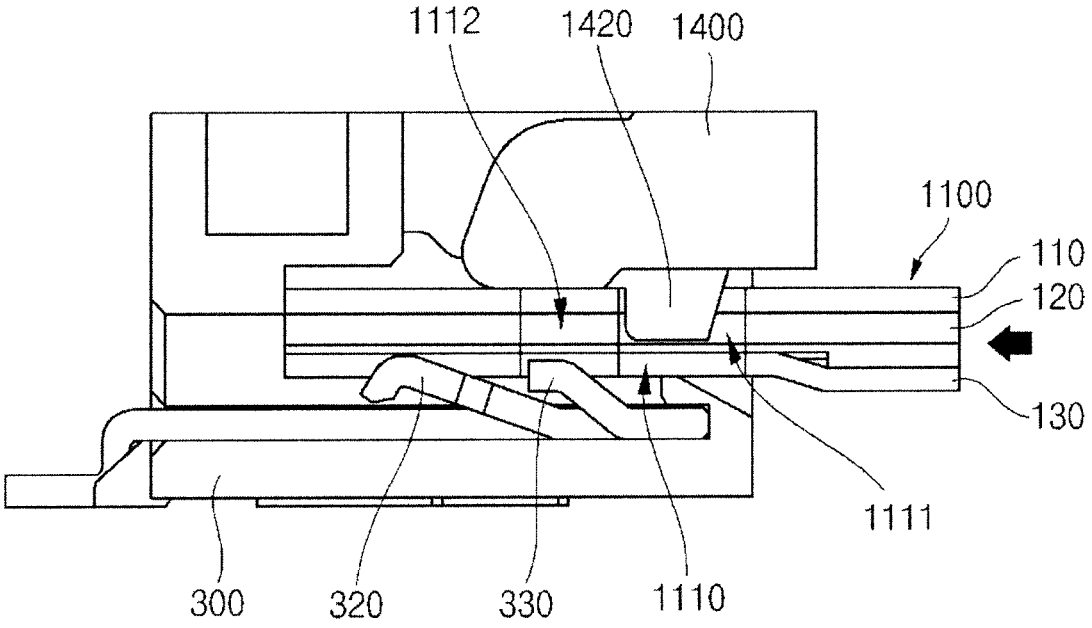

FIGS. 9A and 9B are partially side views illustrating a relationship between the insertion piece 1420 of the actuator 1400 and the guide opening 1110 of the FFC 1100 shown in FIGS. 7A and 8. Specifically, FIG. 9A illustrates a state in which the insertion piece 1420 of the actuator 1400 corresponds to the first region 1111 of the guide opening 1110 of the FFC 1100, that is, a unlocked state of the actuator 1400, and FIG. 9B illustrates a state in which the insertion piece 1420 of the actuator 1400 is inserted into the second region 1112 of the guide opening 1110 of the FFC 1100, that is, a locked state of the actuator 1400.

Meanwhile, as described above, the elastic piece 320 and the locking piece 330 are formed on the fitting nail 300 and may correspond to the openings 111, 121 and 131 formed at opposite edges of the FFC (100 of FIG. 2).

In the embodiment of the present invention, the guide opening 1110 of the FFC 1100 corresponds to the rear end of the locking piece 330 of the fitting nail 300 (in view of the inserted direction of the FFC). With this configuration, interference may occur between the guide opening 1110 and the locking piece 330 of the fitting nail 300, making it difficult to provide the guide opening 1110 having a sufficiently area.

Therefore, in the embodiment of the present invention, the first region 1111 of the guide opening 1110 of the FFC 1100 is formed at a region adjacent to the locking piece 330 of the fitting nail 300, thereby preventing the actuator 1400 from being rotated when the FFC 1100 is not completely inserted into the housing of the connector.

Here, the guide opening 1110 of the FFC 1100 and the insertion piece 1420 of the actuator 1400 performing the aforementioned functions may allow the FFC 1100 to be completely inserted into the housing of the connector. In addition, it is also possible to prevent the FFC 1100 coupled to the housing of the connector from being unintendedly separated from the housing of the connector together with the locking piece 330 of the fitting nail 300.

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A connector comprising:

a housing;

a plurality of contacts fixedly disposed in the housing; and a fitting nail disposed at least one side end portion of the housing, wherein the fitting nail includes a base having a cut-out portion formed therein and fixedly disposed at an end portion of an internal space of the housing, an elastic piece upwardly extending from the base and pressed toward the base by an external force and a locking piece extending toward the cut-out portion in a state in which it is upwardly inclined from a rear end portion of the base.

2. The connector of claim 1, wherein the elastic piece extends from a region adjacent to the cut-out portion toward the cut-out portion.

3. The connector of claim 2, wherein the elastic piece comprises:

first and second extending members upwardly extending from a front end portion of the base and spaced from each other; and a connecting member connecting front ends of the first and second extending members.

4. The connector of claim 3, wherein the connecting member has one portion corresponding to the front end portion of the base and the other portion which is opposite to the portion and is downwardly inclined toward the cut-out portion.

5. The connector of claim 3, wherein the fitting nail is positioned between the first and second extending members of the elastic piece and further includes a locking piece extending toward the cut-out portion in a state in which it is upwardly inclined from the front end portion of the base.

6. The connector of claim 2, wherein the elastic piece extends from the front end portion of the base toward the cut-out portion and has a free end downwardly inclined toward the cut-out portion.

7. The connector of claim 6, wherein a top surface of the free end portion of the elastic piece is recessed over the entire width thereof.

8. The connector of claim 1, the fitting nail further comprises a guide pin positioned on the base and disposed at the exterior side of the elastic piece to be parallel with the elastic piece.

9. An assembly of a cable and a connector, comprising:

a connector;

an actuator mounted on the connector; and a cable electrically and mechanically connected to the connector, wherein the connector comprises a housing, a plurality of contacts fixedly disposed in the housing, and a fitting nail disposed at least one side end portion of the housing, wherein the fitting nail includes a base having a cut-out portion formed therein and fixedly disposed at a longitudinal section of an internal space of the housing, an elastic piece upwardly extending from the base and pressed toward the base by an external force and a locking piece extending upward from the base toward the cut-out portion to prevent a separation of the cable from the connector caused by an external force, and wherein the cable has a plurality of conductive patterns formed at its front end and when it is pressed by the actuator, a side end portion of the cable presses the elastic piece of the fitting nail to allow the conductive patterns to make contact with contacts of the connector.

10. The assembly of claim 9, wherein the elastic piece extends from a region adjacent to the cut-out portion toward the cut-out portion.

11. The assembly of claim 9, wherein the elastic piece of the fitting nail comprises first and second extending members upwardly extending from the front end portion of the base and spaced from each other; and a connecting member connecting front ends of the first and second extending members, and the locking piece is positioned between the first and second extending members of the elastic piece and extending upward and toward the cut-out portion from the front end portion of the base.

12. The assembly of claim 11, wherein the cable has an opening formed at a front end portion of the exterior side thereof so that the locking piece of the fitting nail is accommodated in the opening of the cable when the cable is pressed by the actuator, wherein the front end surface of the locking piece makes contact with a surface forming the opening to prevent a separation of the cable from the connector caused by an external force.

13. The assembly of claim 9, wherein the base has a cut-out portion formed thereon, the elastic piece extends from the front end portion of the base toward the cut-out portion and its free end is downwardly inclined toward the cut-out portion and the locking piece extends from the rear end portion of the base toward the cut-out portion in a state in which the locking piece is upwardly inclined from a rear end portion of the base.

14. The assembly of claim 13, wherein a top surface of the free end portion of the elastic piece is recessed over the entire width thereof.

15. The assembly of claim 13, wherein the cable has an opening formed at a front end portion of the exterior side of thereof so that the locking piece of the fitting nail is accommodated in the opening of the cable when the cable is pressed by the actuator, wherein the front end surface of the locking piece makes contact with a surface forming the opening to prevent a separation of the cable from the connector caused by an external force.

16. The assembly of claim 9, wherein the fitting nail further comprises a guide piece positioned on the base and disposed at the exterior side of the elastic piece to be parallel with the elastic piece to guide the cable to be inserted into the connector.

17. The assembly of claim 9, wherein the cable comprises:

a base member having conductive patterns formed at its front ends and an opening formed at the front end portion of at least one side; and upper and lower reinforcement members attached to upper and lower portions of the base member, wherein portions of front ends of the upper and lower reinforcement members are removed to allow the conductive patterns of the base member to be exposed to the outside, and openings are formed on the base member and front ends of the side portions of the upper and lower reinforcement members to form one opening into which the locking piece of the fitting nail is inserted in a state in which the base member and the upper and lower reinforcement members are adhered to each other.

18. The assembly of claim 17, wherein one or more thin metal sheet regions are disposed at one or more side portions of the upper and lower reinforcement members of the cable, and one or more bonding openings are formed at one or more side portions of the base member, so that in a state in which the upper reinforcement member, the base member and the lower reinforcement member are stacked one on the other, the metal sheet regions formed at the lower reinforcement member and the upper reinforcement member are allowed to correspond to each other through the bonding openings of the base member, and the upper reinforcement member, the base member and the lower reinforcement member are integrally bonded by welding the metal sheet regions.

19. The assembly of claim 9, wherein a guide opening is formed on at least one of opposite side portions of the cable, the guide opening is divided into a first region formed at its front end and a second region formed at its rear end, the second region has a greater width than the first region, and wherein an insertion piece is formed on at least one of bottom surfaces of the opposite edges of a main body of the actuator, the insertion piece has the same width as that of the second region of the guide opening of the cable to allow the actuator to be locked only when the insertion piece of the actuator corresponds to the second region of the guide opening of the cable.

* * * * *